US010529285B2

(12) United States Patent
Vahid Far et al.

(10) Patent No.: US 10,529,285 B2
(45) **Date of Patent: *Jan. 7, 2020**

(54) SYSTEM AND METHOD FOR EXTERNAL PIXEL COMPENSATION

(71) Applicant: Apple Inc., Cupertino, CA (US)

(72) Inventors: Mohammad B. Vahid Far, San Jose, CA (US); Jesse A. Richmond, San Francisco, CA (US); Yafei Bi, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/136,076

(22) Filed: Sep. 19, 2018

(65) Prior Publication Data

US 2019/0019459 A1 Jan. 17, 2019

Related U.S. Application Data

(63) Continuation of application No. 15/270,952, filed on Sep. 20, 2016, now Pat. No. 10,096,284.

(60) Provisional application No. 62/357,059, filed on Jun. 30, 2016.

(51) Int. Cl.
*G09G 3/3258* (2016.01)
*G09G 3/3208* (2016.01)
(Continued)

(52) U.S. Cl.
CPC ..... *G09G 3/3258* (2013.01); *G09G 3/3208* (2013.01); *G09G 3/3266* (2013.01);
(Continued)

(58) Field of Classification Search
CPC .. G09G 3/3258; G09G 3/3208; G09G 3/3266; G09G 3/3275; G09G 3/3291; G09G 3/3225; G09G 2300/043; G09G 2300/0828; G09G 2310/027; G09G 2310/08; G09G 2320/0242; G09G 2320/0285; G09G 2320/0295; G09G 2320/043; G09G 2320/045
See application file for complete search history.

(56) References Cited

U.S. PATENT DOCUMENTS 9,305,492 B2 4/2016 Takahama et al.
2006/0077137 A1 4/2006 Kwon
(Continued)

FOREIGN PATENT DOCUMENTS

JP 2011059596 A 3/2011
WO 2014021201 A1 2/2014

OTHER PUBLICATIONS

International Search Report and Written Opinion for PCT Application PCT/US2017/033343 dated Jul. 28, 2017; 16 pgs.
(Continued)

*Primary Examiner* — Peter D McLoone
(74) *Attorney, Agent, or Firm* — Fletcher Yoder, P.C.

(57) ABSTRACT

An electronic device includes a display panel. The display panel includes a number of pixels, each of which includes a driving thin-film-transistor (TFT) and a light-emitting diode. Compensation circuitry external to the display panel applies offset data to pixel data for each pixel of the plurality of pixels before the pixel data is provided to the plurality of pixels.

20 Claims, 10 Drawing Sheets

(51) Int. Cl.

| | |
|---|---|
| ***G09G 3/3275*** | (2016.01) |
| ***G09G 3/3266*** | (2016.01) |
| ***G09G 3/3291*** | (2016.01) |
| *G09G 3/3225* | (2016.01) |

(52) U.S. Cl.
CPC ..... *G09G 3/3275* (2013.01); *G09G 3/3291* (2013.01); *G09G 3/3225* (2013.01); *G09G 2300/043* (2013.01); *G09G 2300/0828* (2013.01); *G09G 2310/027* (2013.01); *G09G 2310/08* (2013.01); *G09G 2320/0233* (2013.01); *G09G 2320/0242* (2013.01); *G09G 2320/0285* (2013.01); *G09G 2320/0295* (2013.01); *G09G 2320/043* (2013.01); *G09G 2320/045* (2013.01)

(56) References Cited

U.S. PATENT DOCUMENTS

| | | | | |
|---|---|---|---|---|
| 2007/0210996 | A1 | 9/2007 | Mizukoshi et al. | |
| 2008/0074413 | A1 | 3/2008 | Ogura | |
| 2010/0141493 | A1 * | 6/2010 | Cho ..... | G09G 3/20 341/122 |
| 2011/0018858 | A1 | 1/2011 | Ryu | |
| 2012/0169700 | A1 | 7/2012 | Mori | |
| 2013/0235023 | A1 | 9/2013 | Chaji et al. | |
| 2015/0187278 | A1 | 7/2015 | Park | |
| 2015/0379909 | A1 | 12/2015 | Yu et al. | |

OTHER PUBLICATIONS

Japanese Office Action for Japanese Patent Application No. 2018-55043 dated Sep. 13, 2019; 4 pgs.

* cited by examiner

SYSTEM AND METHOD FOR EXTERNAL PIXEL COMPENSATION

CROSS REFERENCE TO RELATED APPLICATIONS

This application is a continuation of U.S. patent application Ser. No. 15/270,952, entitled "SYSTEM AND METHOD FOR EXTERNAL PIXEL COMPENSATION", filed Sep. 20, 2016, which is the Non-Provisional Patent Application of U.S. Provisional Patent Application No. 62/357,059, entitled "SYSTEM AND METHOD FOR EXTERNAL PIXEL COMPENSATION", filed Jun. 30, 2016, both of which are herein incorporated by reference herein in its entirety for all purposes.

BACKGROUND

This disclosure relates to external compensation for shifts in operational parameters in display panels. More specifically, the current disclosure relates to performing external compensation when these operational parameters shift.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Numerous electronic devices include electronic displays, which display images by varying the amount of light that is emitted from an array of pixels of different colors. For pixels that use self-emissive elements, such as organic light emitting diodes (OLEDs), pixel non-uniformities may arise due to light-emitting diode (LED) voltage changes (e.g., Voled), and/or LED current changes (e.g., Ioled). These pixel non-uniformities could produce a degradation in image quality as pixels change over time. Changes in the pixels may be caused by many different factors. For example, changes in the pixels may be caused by temperature changes of the display, an aging of the display (e.g., aging of the thin-film-transistors (TFTs)), the operation of certain display processes, and other factors.

To counteract image degradation caused by changes in the display, it may be desirable to implement in-pixel or per-pixel compensation for the changes. Yet as pixels per inch (PPI) increase, in-pixel or per-pixel compensation logic for these changes may become more and more limited. For example, high pixel-per-inch displays may include a smaller pixel circuit footprint. Thus, a size of the in-pixel or per-pixel compensation circuits may become a limiting factor. Further, timing constraints for these high-PPI displays may result timing limitations on the in-pixel or per-pixel compensation circuits.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

To improve image quality and consistency, external compensation circuitry may be used to counter-act negative artifacts caused by variations (e.g., threshold voltage (Vth) shifts) within a pixel. Further, the external compensation circuitry may be used to counter-act negative artifacts from light-emitting diode (LED) (e.g., organic light-emitting diode) voltage shifts that may occur over time. In the current embodiments, lines carrying a data voltage (Vdata) and/or an reference voltage (Vref) may be used to sense the threshold voltages (Vth), LED voltages (Voled) and/or an LED current (e.g., Ioled) that may be used for subsequent compensation that is external to the pixel circuitry. For example, offset data based upon Vth, Voled and/or Ioled values may be used in compensation logic that adjusts a display output based upon inconsistencies between pixels of a display.

As mentioned above, in-pixel compensation may be used to correct pixel non-uniformity. Such compensation may utilize a capacitor of the pixel to store data relating to the pixel. This stored data may then be used for pixel compensation in a separate step. Unfortunately, in-pixel compensation may, at times, be slow, utilizing a significant amount of time to store data and then utilize the data for pixel compensation. Additionally, the hardware requirements for in-pixel compensation may be significant for certain electronic devices (especially electronic devices with a small integrated circuit footprint). For example, the storage capacitor used to store the pixel information may be quite large, requiring a significant amount of circuitry area of a limited integrated circuit footprint.

Accordingly, in some embodiments described herein, external compensation techniques may obtain certain information about the display panel and alter the input data that is provided to display panel, prior to reaching the display panel (e.g., external to the pixel circuitry). The alterations of the input data effectively compensate for non-uniformity based upon the information obtained about the display panel. For example, non-uniformity that may be corrected using the current techniques may include: neighboring pixels that have similar data, but different luminance, color non-uniformity between neighboring pixels, pixel row inconsistencies, pixel column inconsistencies, etc. As will be discussed in more detail below, an offset digital-to-analog-converter may be used to apply offset data to pixel data, resulting in externally compensated pixel data for implementation on the display panel.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding additional embodiments that also incorporate the recited features.

This disclosure relates to external compensation for non-uniformity that may occur in in display panels. More specifically, the current embodiments describe techniques for external-to-the-pixel application of offset data, where the offset data describes the non-uniformity at a pixel level.

Figure 1:
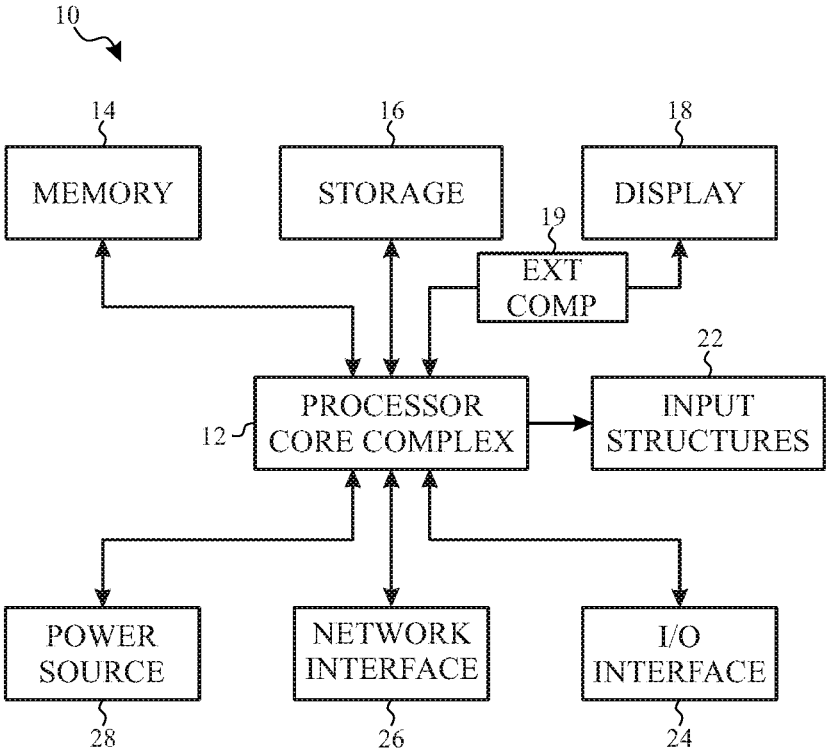
FIG. 1 is a schematic block diagram of an electronic device including a display, in accordance with an embodiment.

Turning first to FIG. 1, an electronic device 10 according to an embodiment of the present disclosure may include, among other things, a processor core complex 12 having one or more processor(s), memory 14, nonvolatile storage 16, a display 18, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
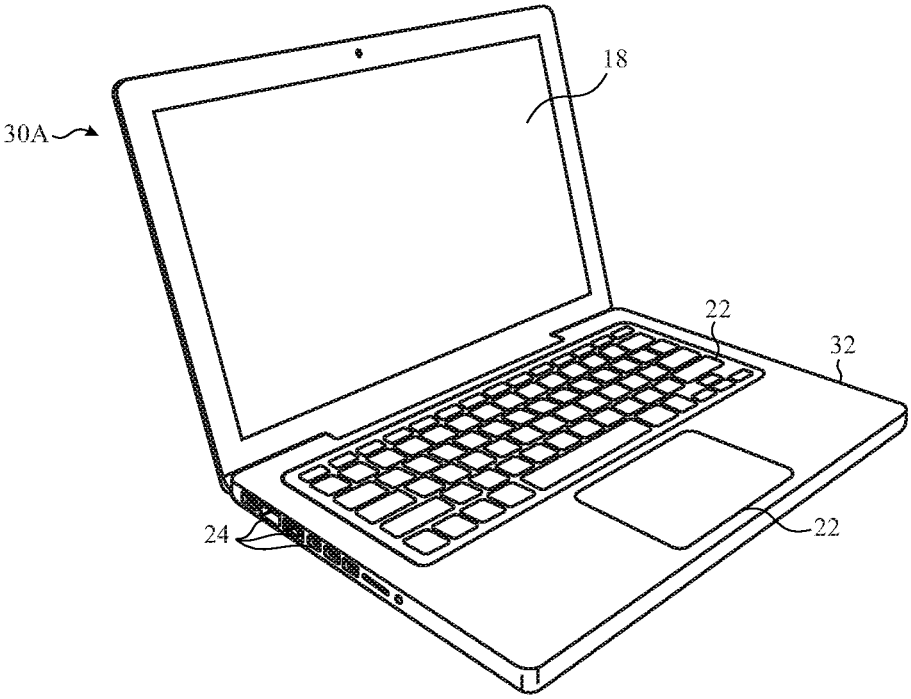
FIG. 2 is a perspective view of a notebook computer representing an embodiment of the electronic device of FIG. 1, in accordance with an embodiment.
Figure 3:
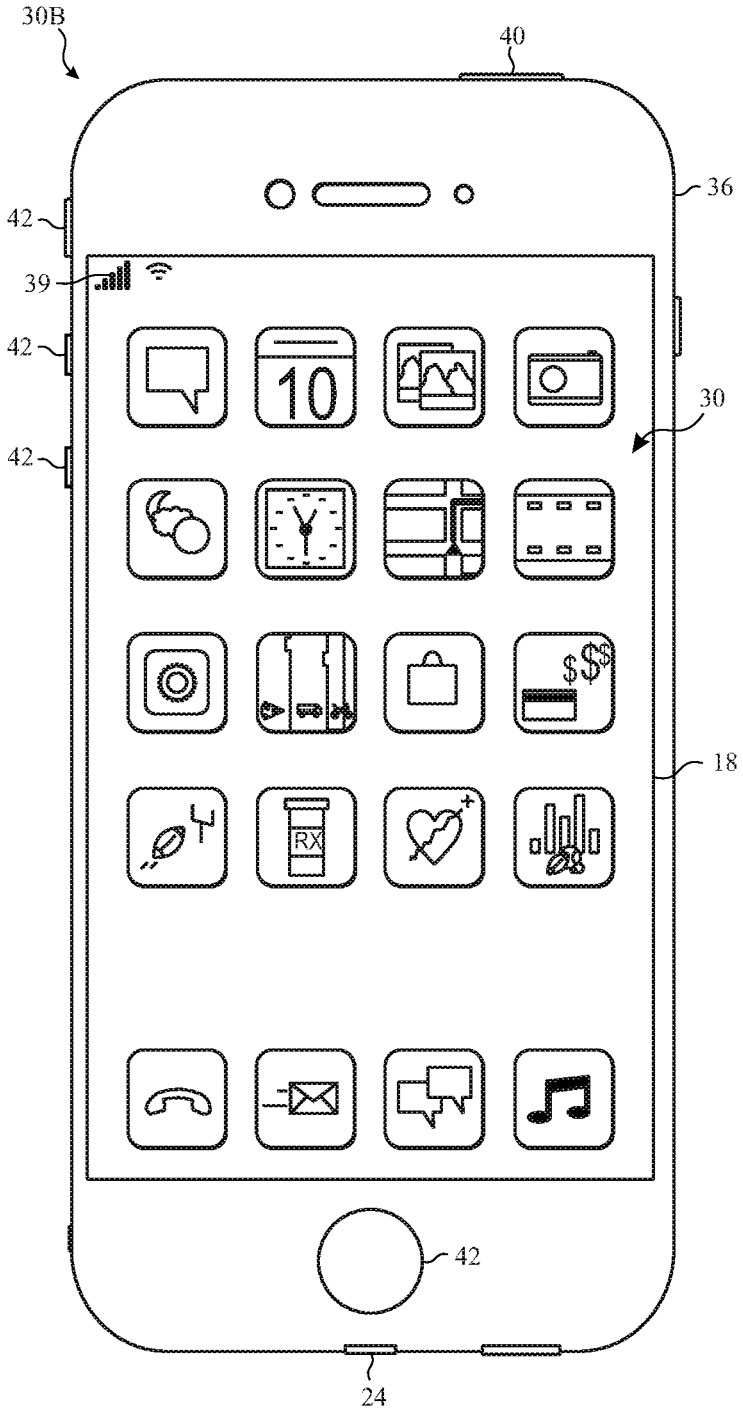
FIG. 3 is a front view of a hand-held device representing another embodiment of the electronic device of FIG. 1, in accordance with an embodiment.
Figure 4:
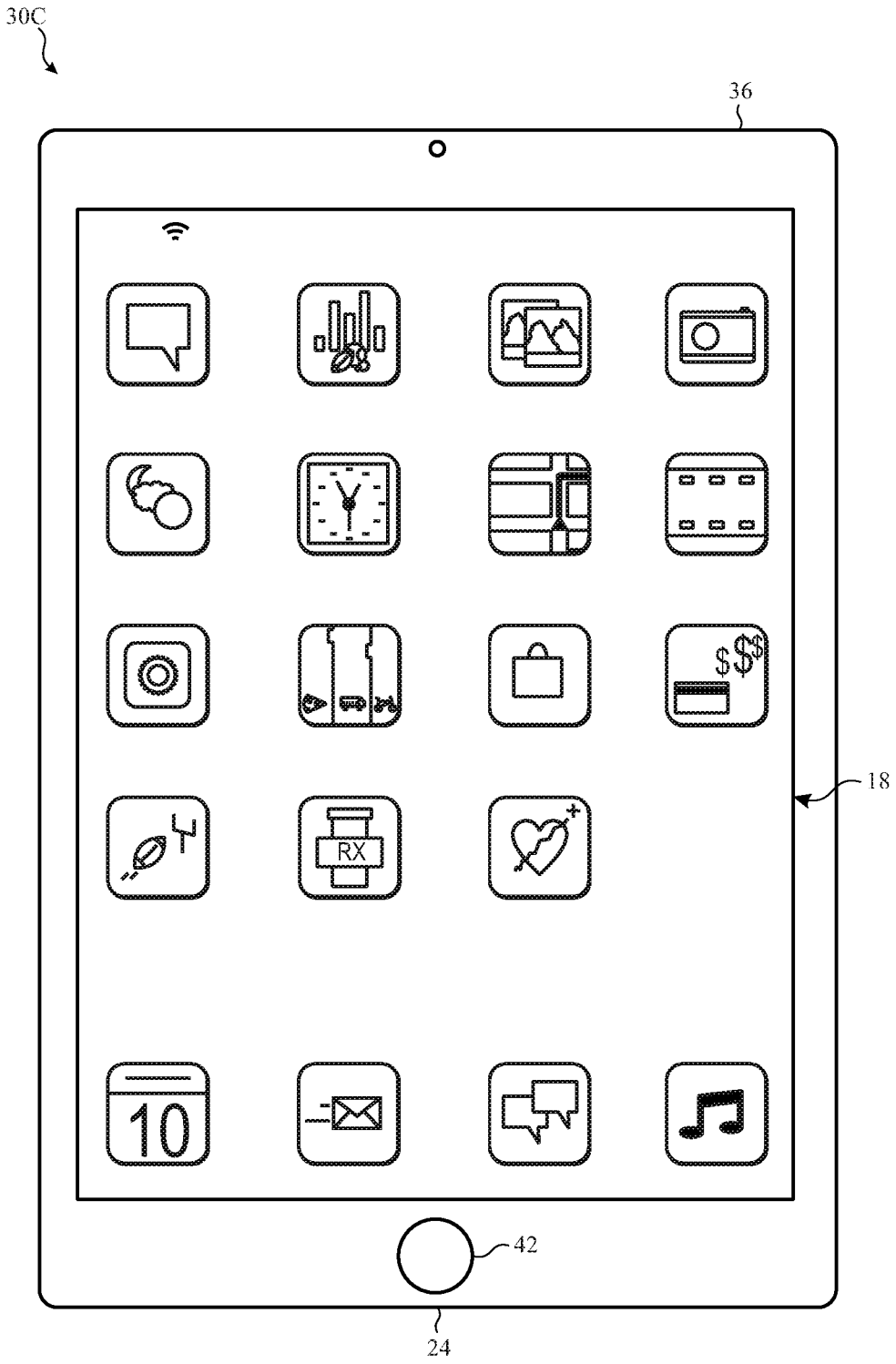
FIG. 4 is a front view of another hand-held device representing another embodiment of the electronic device of FIG. 1, in accordance with an embodiment.
Figure 5:
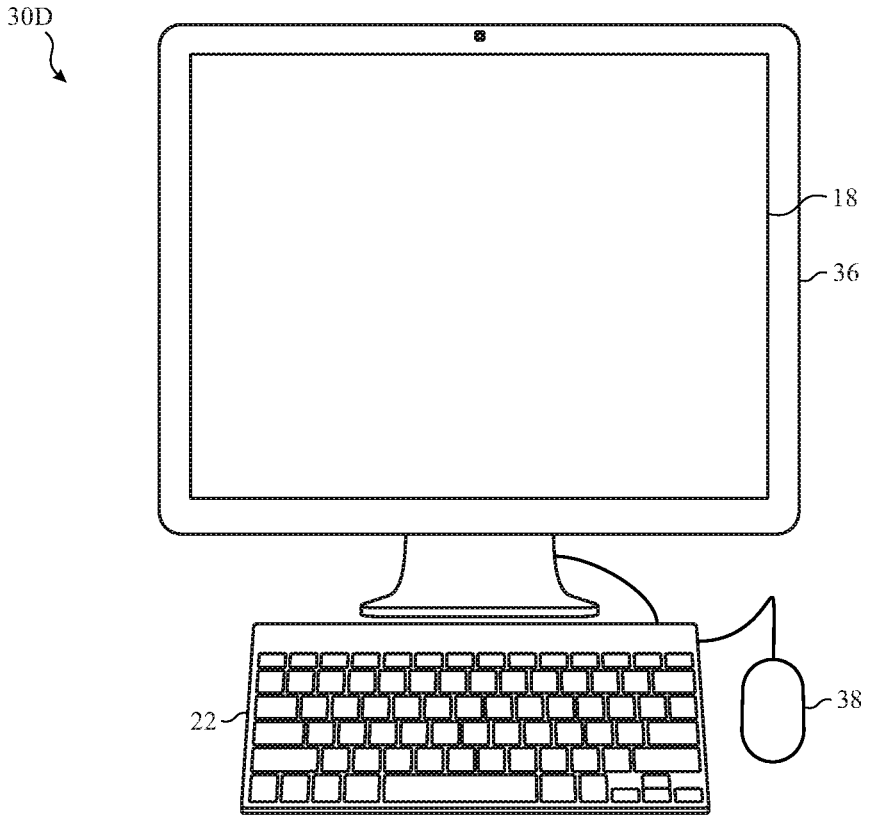
FIG. 5 is a front view of a desktop computer representing another embodiment of the electronic device of FIG. 1, in accordance with an embodiment.

By way of example, the electronic device 10 may represent a block diagram of the notebook computer depicted in FIG. 2, the handheld device depicted in FIG. 3, the desktop computer depicted in FIG. 4, the wearable electronic device depicted in FIG. 5, or similar devices. It should be noted that the processor core complex 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor core complex 12 and/or other data processing circuitry may be operably coupled with the memory 14 and the nonvolatile storage 16 to perform various algorithms. Such programs or instructions executed by the processor core complex 12 may be stored in any suitable article of manufacture that may include one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor core complex 12 to enable the electronic device 10 to provide various functionalities.

As will be discussed further below, the display 18 may include pixels such as organic light emitting diodes (OLEDs), micro-light-emitting-diodes (μ-LEDs), or any other light emitting diodes (LEDs). Further, the display 18 is not limited to a particular pixel type, as the circuitry and methods disclosed herein may apply to any pixel type. Accordingly, while particular pixel structures may be illustrated in the present disclosure, the present disclosure may relate to a broad range of lighting components and/or pixel circuits within display devices.

As discussed in more detail below, external compensation circuitry 19 may alter display data that is fed to the display 18, prior to the display data reaching this display 18 (or a pixel portion of the display 18). This alteration of the display data may effectively compensate for non-uniformities of the pixels of the display 18. For example, non-uniformity that may be corrected using the current techniques may include: neighboring pixels that have similar data, but different luminance, color non-uniformity between neighboring pixels, pixel row inconsistencies, pixel column inconsistencies, etc.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $^{3rd}$ generation (3G) cellular network, $^{4th}$ generation (4G) cellular network, or long term evolution (LTE) cellular network. The network interface 26 may also include interfaces for, for example, broadband fixed wireless access networks (WiMAX), mobile broadband Wireless networks (mobile WiMAX), asynchronous digital subscriber lines (e.g., 15SL, VDSL), digital video broadcasting-terrestrial (DVB-T) and its extension DVB Handheld (DVB-H), ultra Wideband (UWB), alternating current (14) power lines, and so forth.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 42, in combination with the display 18, may allow a user to control the handheld device 30B. For example, the input structure 40 may activate or deactivate the handheld device 30B, the input structure 42 may navigate user interface to a home screen, a user-configurable application screen, and/or activate a voice-recognition feature of the handheld device 30B, the input structures 42 may provide volume control, or may toggle between vibrate and ring modes. The input structures 42 may also include a microphone may obtain a user's voice for various voice-related features, and a speaker may enable audio playback and/or certain phone capabilities. The input structures 42 may also include a headphone input may provide a connection to external speakers and/or headphones.

FIG. 4 depicts a front view of another handheld device 30C which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (PC) by another manufacturer. A similar enclosure 36 may be provided to protect and enclose internal components of the computer 30D such as the display 18. In certain embodiments, a user of the computer 30D may interact with the computer 30D using various peripheral input devices, such as the input structures 22 or mouse 38, which may connect to the computer 30D via a wired and/or wireless I/O interface 24.

Figure 6:
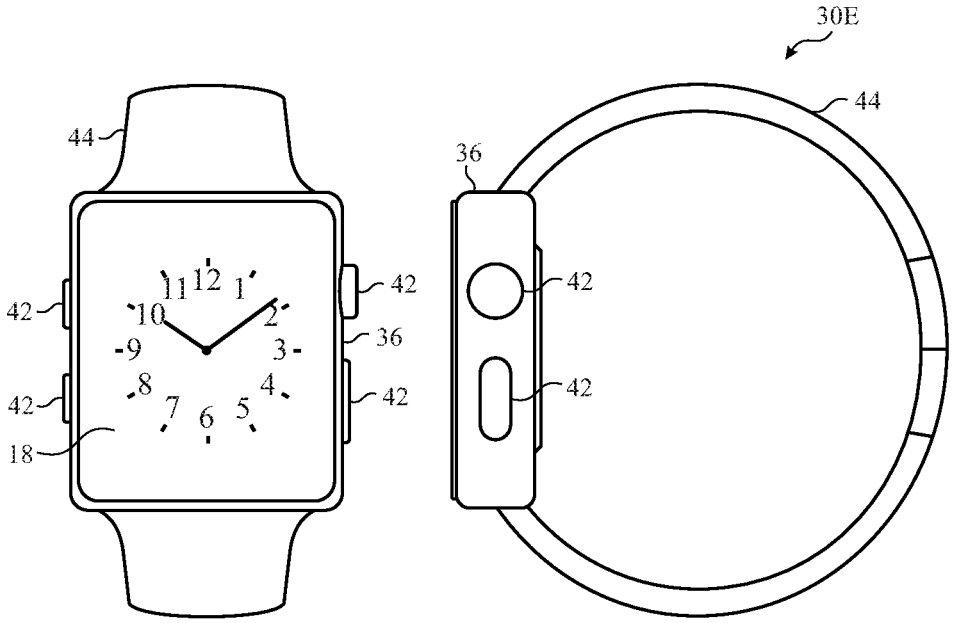
FIG. 6 is a front view of a wearable electronic device representing another embodiment of the electronic device of FIG. 1, in accordance with an embodiment.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen, which may allow users to interact with a user interface of the wearable electronic device 30E.

Figure 7:
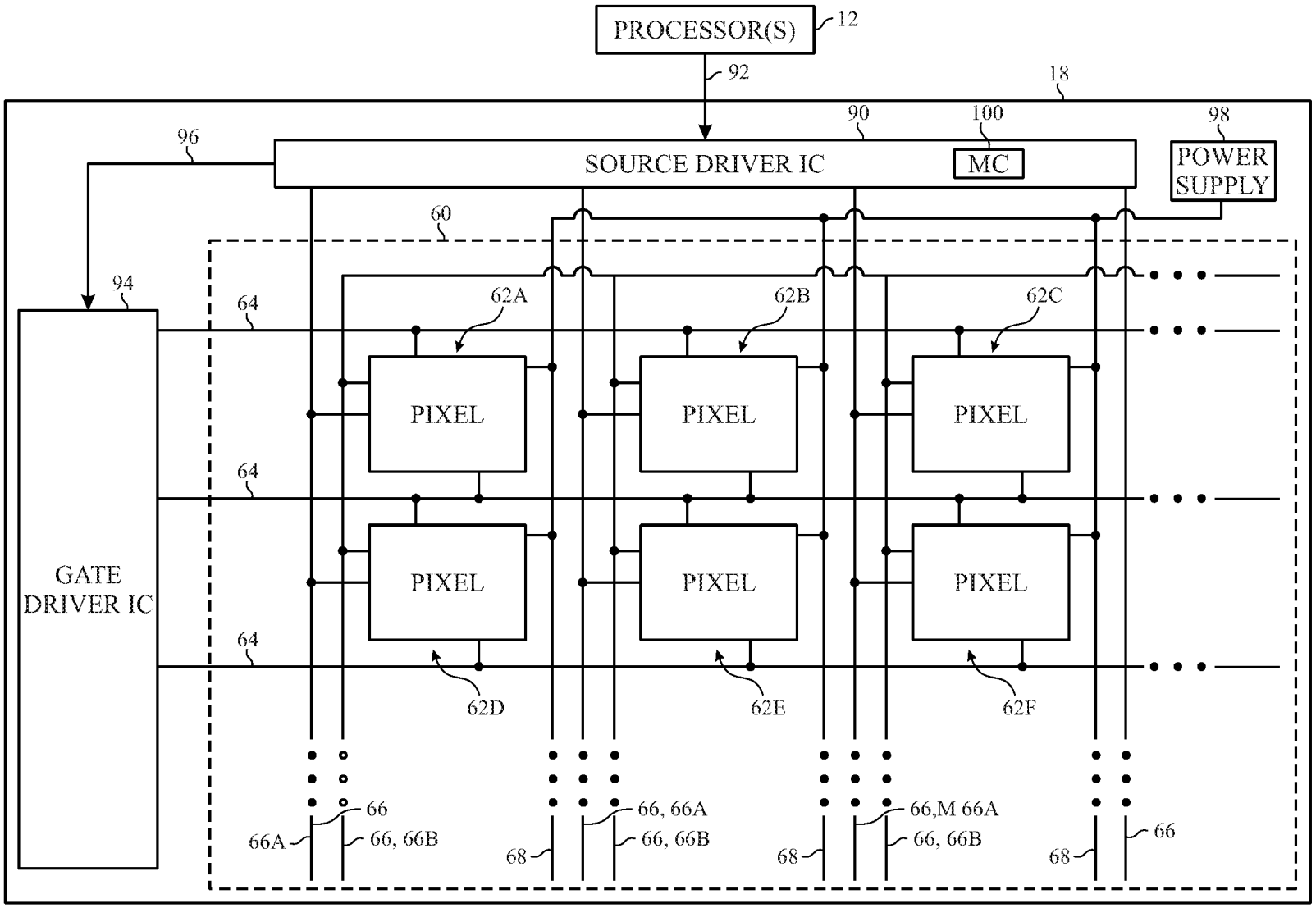
FIG. 7 is a circuit diagram illustrating a portion of a matrix of pixels of the display of FIG. 1, in accordance with an embodiment.

The display 18 for the electronic device 10 may include a matrix of pixels that contain light emitting circuitry. Accordingly, FIG. 7 illustrates a circuit diagram including a portion of a matrix of pixels of the display 18. As illustrated, the display 18 may include a display panel 60. Moreover, the display panel 60 may include multiple unit pixels 62 (here, six unit pixels 62A, 62B, 62C, 62D, 62E, and 62F are shown) arranged as an array or matrix defining multiple rows and columns of the unit pixels 62 that collectively form a viewable region of the display 18 in which an image may be displayed. In such an array, each unit pixel 62 may be defined by the intersection of rows and columns, represented here by the illustrated gate lines 64 (also referred to as "scanning lines") and data lines 66 (also referred to as "source lines"), respectively. Additionally, power supply lines 68 may provide power to each of the unit pixels 62.

Although only six unit pixels 62, referred to individually by reference numbers 62*a*-62*f*, respectively, are shown, it should be understood that in an actual implementation, each data line 66 and gate line 64 may include hundreds or even thousands of such unit pixels 62. By way of example, in a color display panel 60 having a display resolution of 1024×768, each data line 66, which may define a column of the pixel array, may include 768 unit pixels, while each gate line 64, which may define a row of the pixel array, may include 1024 groups of unit pixels with each group including a red, blue, and green pixel, thus totaling 3072 unit pixels per gate line 64. By way of further example, the panel 60 may have a resolution of 480×320 or 960×640. In the presently illustrated example, the unit pixels 62 may represent a group of pixels having a red pixel (62A), a blue pixel (62B), and a green pixel (62C). The group of unit pixels 62E, 62E, and 62F may be arranged in a similar manner. Additionally, in the industry, it is also common for the term "pixel" may refer to a group of adjacent different-colored pixels (e.g., a red pixel, blue pixel, and green pixel), with each of the individual colored pixels in the group being referred to as a "sub-pixel."

The display 18 also includes a source driver integrated circuit (IC) 90, which may include a chip, such as a processor or ASIC, configured to control various aspects of the display 18 and panel 60. For example, the source driver IC 90 may receive image data 92 from the processor core complex 12 and send corresponding image signals to the unit pixels 62 of the panel 60. The source driver IC 90 may also be coupled to a gate driver IC 94, which may be configured to provide/remove gate activation signals to activate/deactivate rows of unit pixels 62 via the gate lines 64. The source driver IC 90 may include a timing controller that determines and sends timing information/image signals 96 to the gate driver IC 94 to facilitate activation and deactivation of individual rows of unit pixels 62. In other embodiments, timing information may be provided to the gate driver IC 94 in some other manner (e.g., using a timing controller that is separate from the source driver IC 90). Further, while FIG. 7 depicts only a single source driver IC 90, it should be appreciated that other embodiments may utilize multiple source driver ICs 90 to provide timing information/image signals 96 to the unit pixels 62. For example, additional embodiments may include multiple source driver ICs 90 disposed along one or more edges of the panel 60, with each source driver IC 90 being configured to control a subset of the data lines 66 and/or gate lines 64.

In operation, the source driver IC 90 receives image data 92 from the processor core complex 12 or a discrete display controller and, based on the received data, outputs signals to control the unit pixels 62. When the unit pixels 62 are controlled by the source driver IC 90, circuitry within the unit pixels 62 may complete a circuit between a power source 98 and light elements of the unit pixels 62. Additionally, to measure operating parameters of the display 18, measurement circuitry 100 may be positioned within the source driver IC 90 to read various voltage and current characteristics of the display 18, as discussed in detail below.

The measurements from the measurement circuitry 100 (or other information) may be used to determine offset data for individual pixels (e.g., 62A-F). The offset data may represent non-uniformity between the pixels, such as: neighboring pixels that have similar data, but different luminance, color non-uniformity between neighboring pixels, pixel row inconsistencies, pixel column inconsistencies, etc. Further, the offset data may be applied to the data controlling the pixels (e.g., 62A-F), resulting in compensated pixel data that may effectively remove these inconsistencies.

Figure 8:
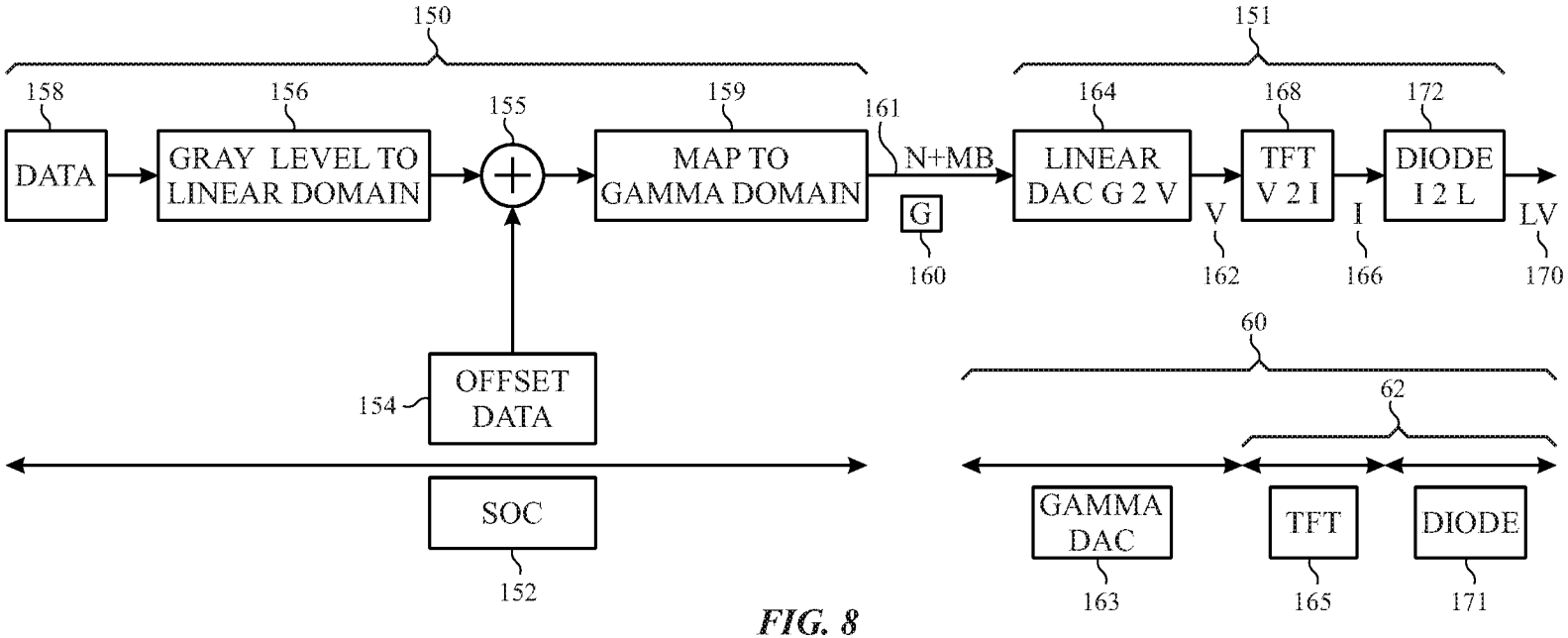
FIG. 8 is a schematic diagram illustrating a process for external compensation of pixels and subsequent processing at the display panel, in accordance with an embodiment.

With this in mind, FIG. 8 illustrates a block diagram of a process 150 for external compensation of pixels 62 and subsequent processing 151 at the display 18, in accordance with an embodiment. Circuitry such as a system on chip (SOC) 152 may be used for pre-processing of pixel data, prior to the data reaching the display panel 60. The pixel data in the SOC 152 is in the digital processing domain. On the SOC 152 side, offset data 154, representing the non-uniformity or mismatch between the pixels 62, is added 155 to the gray level data 156 (voltage values) of the pixels, which are determined using N byte input data 158. This addition of offset data 154 to the gray level data 156, results in N+M byte offset gray level data for each pixel. The offset gray level data is mapped to the gamma domain, as illustrated in block 159. This process 150 is implemented for each pixel 62 of the display panel 60. The mapped offset gray level data 160 for each pixel 62 (e.g., the externally compensated data for each pixel 62) is then provided 161 to the display panel 60.

The display panel 60 may then perform the display panel 60 processing 151. First, the display panel 60 may perform a linear digital-to-analog conversion, converting the data 160 from gray level data (G) to voltage (v) 162 (e.g., via a Gamma DAC 163), as illustrated by block 164. The voltage 162 may be applied to the driving TFT 165, resulting in a current (I) 166, as illustrated by block 168. The current 166 is then applied to a diode of the pixel 62, resulting in outputted light or luminance (Lv) 170 at a diode 171 of the pixel 62, as illustrated by block 172.

The transformations in the SOC 152 may be complex, and could result in additional errors at times. These errors may contribute to non-uniformity of the pixels 62, such as color-mismatching, etc. Further, the increase in input data size (e.g., N+M byte data), may result in an interface that uses higher bandwidth, and thus, uses more power, as well as increased precision to be handled by the DAC 163.

Figure 9:
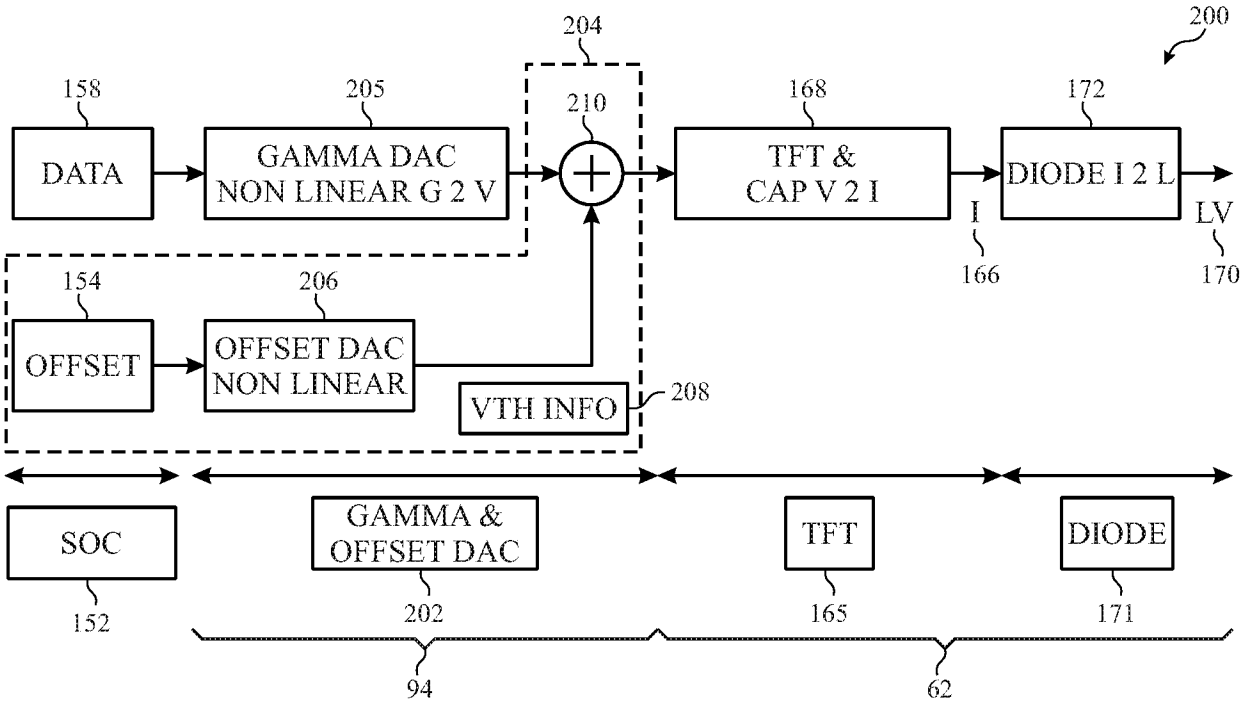
FIG. 9 is a schematic diagram illustrating offset data applied in the driver integrated circuit, in accordance with an embodiment.

In some embodiments, it may be beneficial to apply offset information for the pixel compensation in the driver integrated circuit. FIG. 9 illustrates such an embodiment of circuitry 200, where the offset data is applied in the driver integrated circuit, rather than in the SOC 152 or in the pixel 62. As mentioned above, in the embodiment of FIG. 8, the SOC 152 is modified to allow the offset data 154 to be added 155 to the gray level data 156. Further, because the embodiment of FIG. 8 performs processing in the digital domain, a linear DAC is used to convert the digital gray level data 160 to voltage. In other words, the nonlinear data is mapped to linear data and then back to nonlinear data. Accordingly, the embodiment of FIG. 9, which implements the offset data 154 addition in the driver IC 94, may be beneficial, in that the display pipeline architecture may not be affected by the external compensation. For example, the SOC 152 and pixel 62 may remain untouched. Further, as illustrated in FIG. 9, two parallel interfaces may send the pixel 62 data 158 and the offset data 154, per pixel 62, resulting in increased processing speed.

To perform the external compensation, circuitry is added to perform the driver IC 94 external compensation operations provided in the dashed box 204. As illustrated in FIG. 9, the data 158 for each pixel 62 is provided to a nonlinear gamma DAC 205. Serially or in parallel, the offset data 154 for each pixel 62 is provided to a linear offset DAC 206 of the driver IC 94. The digital-to-analog conversion results in analog offset information (Vth information) 208. The Vth information 208 is added via an addition 210 function to the outputted voltage of the DAC 205 in the driver IC 94. The compensated voltage is passed from the addition 210 function, to the pixel 62, where the voltage is applied to the driving TFT 165, resulting in a current 166 (block 168). The current 166 is applied to the diode 171, resulting in light or luminance (Lv) 170 emitted by the diode 171.

Figure 10:
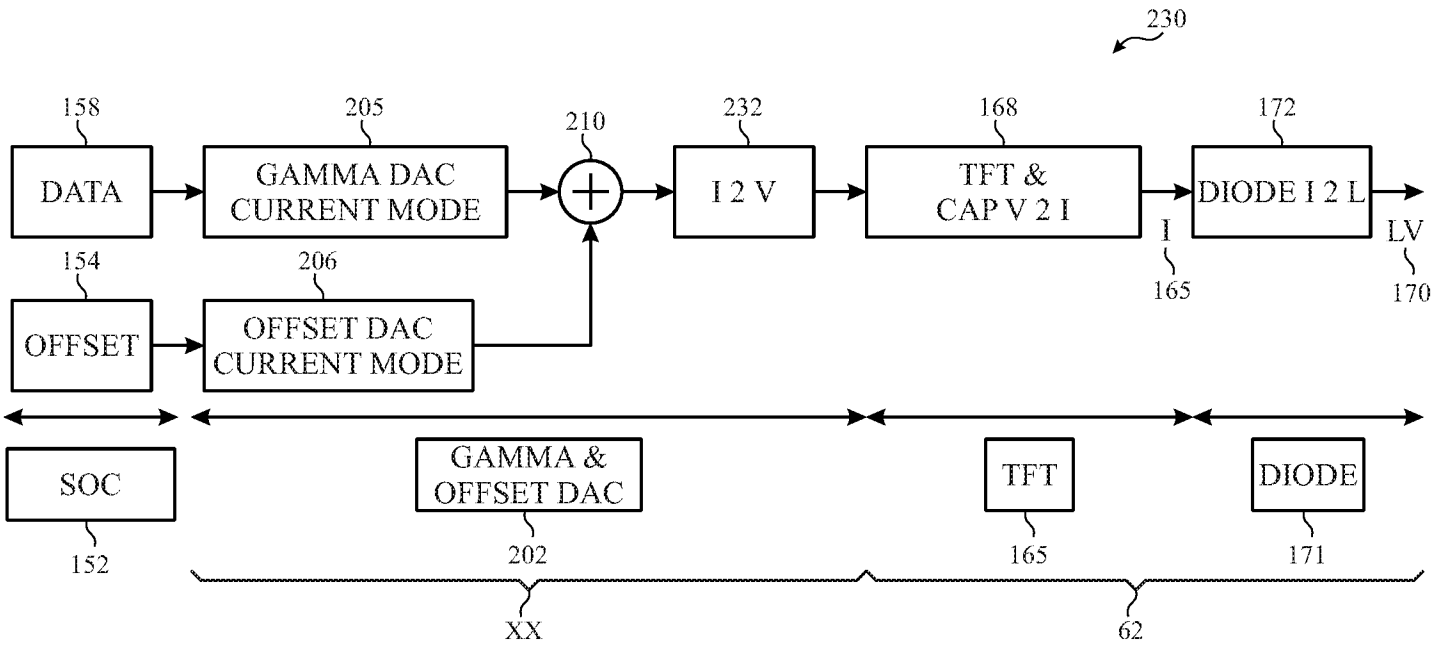
FIG. 10 is a schematic diagram illustrating application of offset data in the current domain, in accordance with an embodiment.

The processing of FIG. 9 may be completed in either the current domain or the voltage domain. FIG. 10 illustrates circuitry 230 to implement the processing of FIG. 9 in the current domain. In the circuitry 230 of FIG. 10, each of the processing steps and circuitry components is similar to those of FIG. 9, except that the nonlinear gamma DAC 205' and the linear offset DAC 206' are in a current mode. Further, because the driving TFT 165 works with voltage, current to voltage (I2V) conversion circuitry 232 may convert the compensated current to voltage, such that voltage is provided to the TFT 165. In some embodiments, the current to voltage conversion may occur on each of the DAC 205 and 206 outputs, prior to the addition 210.

Turning now to the voltage domain implementation, there are a number of techniques that may be implemented to offset the voltage data in the driver IC. In one embodiment, operational amplifiers (OPAMPS) may be used to add the voltage outputs of the two DACs 205 and 206. However, this approach may utilize more power and circuit area, as additional amplifiers per pixel 62 may be used.

Figure 11:
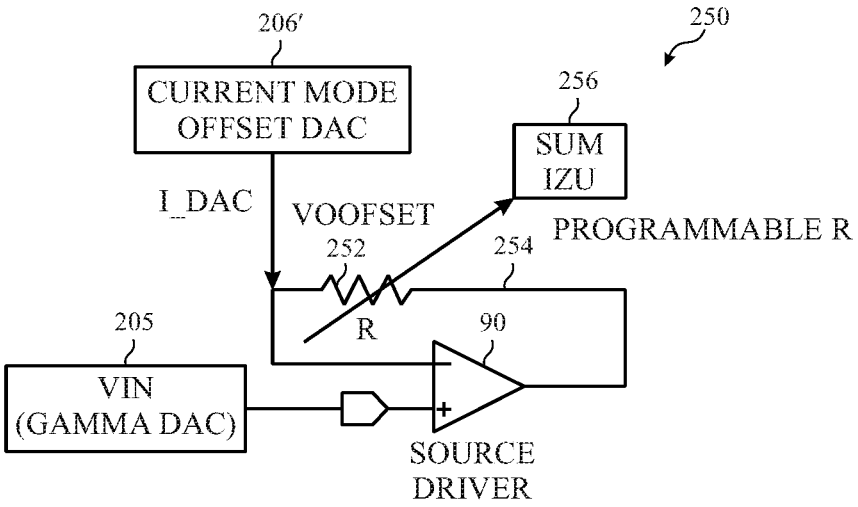
FIG. 11 is a schematic diagram illustrating circuitry that applies offset data in source driver, in accordance with an embodiment.
Figure 12:
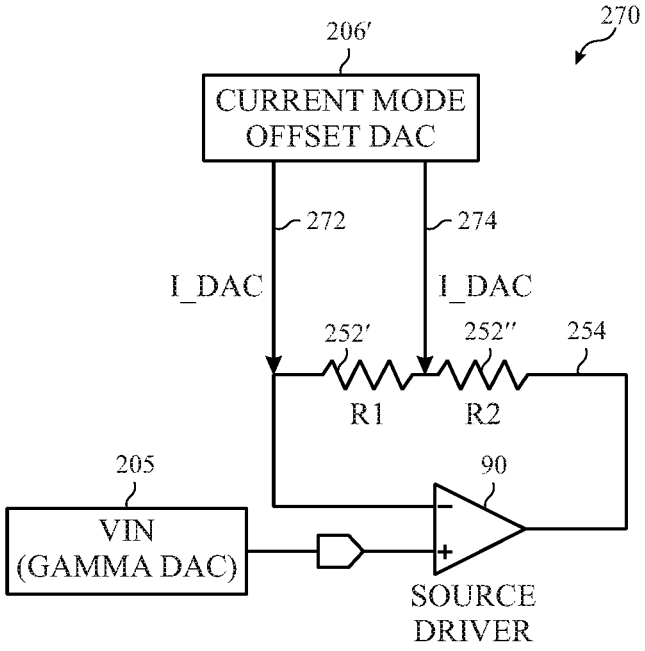
FIG. 12 is a schematic diagram illustrating a more granular version of the embodiment depicted in FIG. 11, in accordance with an embodiment.

Alternatively or additionally, in some embodiments the offset DAC 206 may be embedded in the source driver IC 90. As mentioned above, the source driver IC 90 drives each of the columns of pixels 62. FIGS. 11 and 12 illustrate embodiments where the offset DAC 206 is embedded in the source driver IC 90. As illustrated in the circuitry 250 of FIG. 11, the gamma DAC 205 may provide the input voltage (Vin) for the source driver IC 90. Further, the offset DAC 206' and a resistor 252 are electrically coupled to the feedback path 254 of the source driver IC 90. The resistor 252 may utilize a programmable resistance value that is defined by the voltage offset (VOFFSET). Using this configuration, the summation of the Offset DAC 206' and the gamma DAC 205 may be provided, along with the current-to-voltage conversion (I2V), as illustrated by block 256.

FIG. 12 illustrates circuitry 270 that implements the embedded offset DAC 206' technique of FIG. 11, with a segmented current provided to the source driver IC 90 feedback path 254, for fine-tuning. As illustrated, current outputs 272 and 274 are segmented and separated coupled to the feedback path 254. Corresponding resistors 252' and 252" are used for the respective segmented current outputs 272 and 274. While the current embodiment illustrates two segmented current outputs 272 and 274, any number of current segments may be used, depending on fine-tuning needs.

Figure 13:
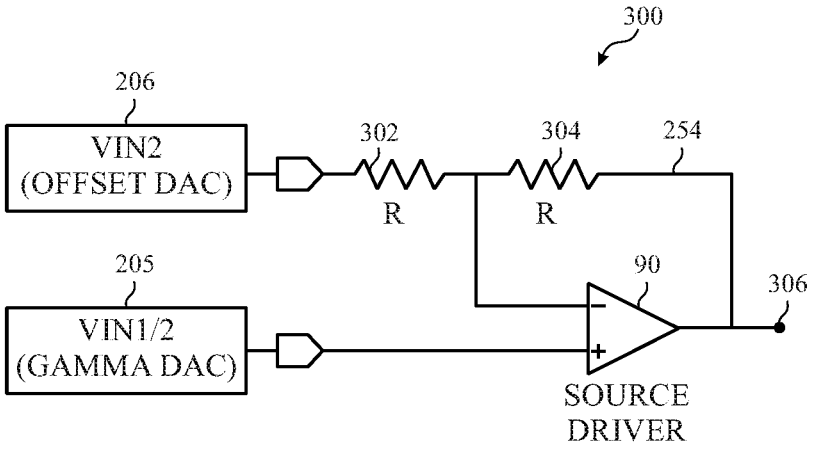
FIG. 13 is a circuit diagram illustration a second phase of voltage sensing, in accordance with an embodiment.

In some embodiments, the gamma DAC 205 and the offset DAC 206 both provide voltages. FIG. 13 illustrates circuitry for adding the gamma DAC 205 and the offset DAC 206, in accordance with an embodiment. As illustrated in FIG. 13, the voltage of the gamma DAC 205 is halved and provided as an input voltage (Vin½) to the source driver IC 90. A resistor 302 is applied to the offset DAC 206 and a resistor 304 is applied to the feedback path 254 of the source driver IC 90. The offset DAC 206 with the applied resistor 302 is embedded in the feedback 254 after the resistor 304. Using this configuration, the output 306 is the offset DAC 206 output added to the gamma DAC 205 output.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising:

a display panel, comprising a plurality of pixels each configured to emit light based on respective pixel data provided to a respective pixel of the plurality of pixels; and processing circuitry comprising adding circuitry, wherein the processing circuitry is configured to:

receive offset data;

convert the offset data to analog offset data via an offset digital-to-analog converter (DAC);

add, using the adding circuitry, the analog offset data to pixel data for the respective pixel of the plurality of pixels to generate compensated pixel data; and transmit the compensated pixel data to the display panel, wherein each pixel of the plurality of pixels are configured to emit light based upon the compensated pixel data respectively transmitted to each pixel, and wherein the adding circuitry is coupled to a resistor disposed in a feedback path coupling an output of the adding circuitry to an output of the offset DAC.

2. The electronic device of claim 1, wherein a first portion of the processing circuitry is disposed within a system on a chip (SOC) separate from the display panel and a second portion of the processing circuitry is disposed within a gate driver integrated circuit separate from the display panel.

3. The electronic device of claim 1, wherein the processing circuitry is configured to map, via a gamma DAC, pixel gray level data to a gamma domain to generate the compensated pixel data.

4. The electronic device of claim 3, wherein the adding circuitry comprises one or more operational amplifiers configured to add an output of the gamma DAC and the output of the offset DAC.

5. The electronic device of claim 1, wherein the pixel data comprises an analog pixel voltage generated based at least in part on digital pixel data received by the processing circuitry.

6. The electronic device of claim 1, wherein a light-emitting diode emits light in response to a current transmitted based at least in part on the compensated pixel data.

7. The electronic device of claim 1, wherein the compensated pixel data comprises compensated current measurements configured to be applied to a driving transistor, resulting in light emission by a light-emitting diode of the respective pixel of the plurality of pixels.

8. The electronic device of claim 1, wherein the adding circuitry comprises an operational amplifier, and wherein the resistor comprises a programmable resistor.

9. The electronic device of claim 8, wherein the output of the offset DAC is segmented into a plurality of currents provided via the feedback path to adding circuitry to facilitate adding the analog offset data to the pixel data.

10. The electronic device of claim 1, wherein the processing circuitry is configured to map, via a non-linear gamma DAC, pixel gray level data to a non-linear gamma domain to generate a non-linear pixel voltage.

11. The electronic device of claim 1, wherein the offset DAC is disposed within a source driver.

12. A method of operating an electronic device with a display panel, comprising:

applying offset data to pixel data to generate compensated pixel data for each pixel of a plurality of pixels of the display panel of the electronic device by:

providing the offset data to a first data converter to convert the offset data into modified offset data;

providing the pixel data to a second data converter to convert the pixel data into modified pixel data based at least in part on gray level data corresponding to the pixel data; and applying the modified offset data to the modified pixel data to generate the compensated pixel data via adding circuitry coupled to a resistor disposed in a feedback path coupling an output of the adding circuitry to an output of the first data converter; and applying, at a driving transistor of each pixel of the plurality of pixels, the compensated pixel data, resulting in a compensated light emission from each pixel of the plurality of pixels.

13. The method of claim 12, wherein the first data converter is configured as an offset digital-to-analog converter (DAC), and wherein the second data converter is configured as a gamma DAC.

14. The method of claim 12, comprising applying analog offset data to the pixel data in a driver integrated circuit of the electronic device.

15. The method of claim 12, wherein the first data converter comprises an offset DAC to generate analog offset data as the modified offset data.

16. The method of claim 12, wherein the second data converter comprises a gamma DAC to generate analog pixel data as the modified pixel data based at least in part on mapping gray level data to a gamma domain.

17. Electronic display circuitry, comprising:

a display panel having a processing unit configured to perform an external compensation, the processing unit comprising:

a gamma digital-to-analog converter (DAC) configured to receive pixel data and convert the pixel data into modified pixel data;

an offset DAC configured to receive offset data and convert the offset data to modified offset data, wherein the offset DAC is coupled to the gamma DAC through adding circuitry; and wherein the processing unit is configured to add the modified offset data to the modified pixel data via the adding circuitry to generate compensated pixel data for each pixel of the display panel, such that the compensated pixel data is configured to cause compensated light emission from the display panel, wherein the processing unit comprises a feedback path comprising a resistor, and wherein the feedback path is configured to electrically couple an output of the adding circuitry to an output of the gamma DAC.

18. The electronic display circuitry of claim 17, wherein the gamma DAC is configured as a non-linear gamma DAC that generates the modified pixel data based at least in part on mapping gray level data to a gamma domain.

19. The electronic display circuitry of claim 17, wherein the display panel comprises a driver integrated circuit external from an active area of the display panel that comprises the offset DAC.

20. The electronic display circuitry of claim 17, wherein the processing unit is configured to operate in a voltage domain, and wherein the resistor is characterized by a programmable resistance value configurable via a voltage signal.

* * * * *